US006230954B1

(12) United States Patent
Ito et al.

(10) Patent No.: US 6,230,954 B1
(45) Date of Patent: May 15, 2001

(54) PAPER FEEDING DEVICE AND PRINTER HAVING THE PAPER FEEDING DEVICE

(75) Inventors: Akihiko Ito; Hideki Watanabe, both of Chiba; Kazuo Yoneyama, Kyoto, all of (JP)

(73) Assignees: Seiko Instruments Inc.; Nintendo Co. Ltd., both of (JP)

( * ) Notice: Subject to any disclaimer, the term of this patent is extended or adjusted under 35 U.S.C. 154(b) by 0 days.

(21) Appl. No.: 09/241,801

(22) Filed: Feb. 2, 1999

(30) Foreign Application Priority Data

Feb. 3, 1998 (JP) ..... 10-022249

(51) Int. Cl.[7] ..... B65H 20/00

(52) U.S. Cl. ..... 226/181; 226/196.1; 242/615.21; 347/222

(58) Field of Search ..... 226/181, 196.1, 226/200; 347/222; 242/615.21

(56) References Cited

U.S. PATENT DOCUMENTS 2,878,621 * 3/1959 Zellers, Jr. et al. .
3,972,461 * 8/1976 Zahradnik et al. ..... 226/89
4,162,786 * 7/1979 Bullock .
4,614,949 * 9/1986 Hakkaku et al. ..... 347/216
4,660,053 * 4/1987 Tsutsumi et al. ..... 347/215
5,268,705 * 12/1993 Dreinhoff et al. ..... 347/218
5,921,687 * 7/1999 Koike et al. .
5,940,108 * 8/1999 Ito ..... 347/197
6,072,515 * 6/2000 Miura ..... 347/222
6,073,825 * 6/2000 Hilker ..... 226/91
6,079,891 * 6/2000 Berthelot .

FOREIGN PATENT DOCUMENTS 8-160790 * 6/1991 (JP) .
3-293177 * 12/1991 (JP) .

* cited by examiner

*Primary Examiner*—Donald P. Walsh
*Assistant Examiner*—Minh-Chau Pham
(74) *Attorney, Agent, or Firm*—Adams & Wilks

(57) ABSTRACT

A paper feeding device has a first guide portion through which paper having a preselected width and thickness is introduced, a second guide portion for receiving the paper introduced into the first guide portion, and at least one connecting guide portion disposed between the first and second guide portions. A paper feeding roller mechanism feeds the paper from the first guide portion to the second guide portion through the connecting guide portion of the paper feeding guide. The paper feeding roller mechanism has a clamping portion for clamping the paper when the paper is fed to the second guide portion. The clamping portion of the paper feeding roller mechanism is disposed generally parallel to the connecting guide portion of the paper feeding guide.

21 Claims, 6 Drawing Sheets

PAPER FEEDING DEVICE AND PRINTER HAVING THE PAPER FEEDING DEVICE

BACKGROUND OF THE INVENTION

1. Field of the Invention

The present invention relates to a paper feeding device and a printer having the paper feeding device, and more particularly to a paper feeding device having a paper feeding guide in which the paper fed through a first paper feeding path portion is fed by a paper feeding roller mechanism to a second paper feeding path portion extending in a direction intersecting with the first paper feeding path portion, and which is provided with first and second main planar portions for defining outer side walls of the first and second paper feeding path portions. The present invention also relates to a printer having the paper feeding device. The present invention also relates to a paper feeding device formed in a limited narrow space as in the case where thermal sensitive continuous paper having a small width wound in the form of a roll in the vicinity of a small size printer such as a thermal printer, integrally built in an electronic equipment such as a small size handy type game machine, and and relates to a printer having such a paper feeding device.

Throughout this specification, the "outer side wall" of the side wall of the paper path portion means the side wall on the side in which the path is convex in the case where the paper feeding path as a whole is bent on one side. Also, the expression that one paper feeding path portion is "extending in a direction intersecting with" another paper feeding path portion means the arrangement in which the two paper path portions are intersected with each other in the case where the two paper feeding path portions are extended straight, respectively. An angle defined by intersecting the two paper feeding path portions may be about 90° or more or less.

2. Description of the Related Art

As shown in FIG. 7, a conventional printer 110 is so constructed as to feed, by a paper feeding roller mechanism 103, the paper introduced through a first paper feeding path portion 101 to a second paper feeding path portion 102 extending in a direction intersecting with the first paper feeding path portion 101. A paper feeding guide 108 has a first main planar portion 106 and a second main planar portion 107 for defining the outer side walls of the first and second paper feeding path portions 101 and 102, respectively.

In the conventional printer 110, a rotation of an output shaft of a motor 3 mounted on a frame 111 to be mounted on a body of the instrument is transmitted through a gear mechanism (not shown) to a feeding screw 112. The rotation of the feeding screw is converted into a reciprocating motion in a paper width direction (direction perpendicular to the paper surface of FIG. 7) along a guide shaft 114 of a head carrier body (head carriage) 115 through a feeding screw pin 113 engaged with a spiral groove on an outer periphery of the feeding screw. At the same time, when the head carrier body 115 is moved forwardly in a direction A1 from the front side to the rear side of the paper surface of FIG. 7, a predetermined print is performed by a thermal head 116 onto the paper located between the thermal head 116 carried on the carrier body 115 and a platen rubber body 119 on a platen body 118 biased by a platen spring 117. A paper feeding roller driver body 123 is rotated through a plurality of one-way clutch type spiral claw portions 122 by a pin 121 biased by a spring 120 when the head carrier body 115 is moved back in a direction A2 of FIG. 7, so that rubber rollers 124 coaxially formed at both ends of the paper feeding roller driver body 123 is rotated by a predetermined angle, thereby feeding the paper clamped between the rubber rollers 124 and an idler roller 125 by one line.

In this conventional printer 110, the interval between the first main planar portion extending in the horizontal direction and the second main planar portion 107 extending in the vertical direction as viewed in FIG. 7 is connected with a slant surface portion 126 slanted substantially at an angle of 45°. In the case where new continuous paper having a width of about 4 cm is inserted between the platens 118 and 119 and the thermal head 116, the leading edge of the paper is inserted from the first paper feeding path portion 101 and is deflected upwardly at the slant surface portion 126 by utilizing the slant of the slant surface portion 126, to be fed to the paper clamping portion between the rollers 124 and 125.

However, in this conventional printer 110, in the case where the thick paper having a thickness of, for example, about 0.1 mm is used, the leading edge of the paper is not sufficiently deflected at the slant surface portion 126 of the paper feeding guide 108. The leading edge is abutted against, for example, the bent portion between the slant surface portion 126 and the second main planar portion 107, and is subjected to resistance which may cause the paper to become hooked hooked actually. Thus, there is a fear that the leading edge of the paper would not reach the clamping portion between the rollers 124 and 125.

SUMMARY OF THE INVENTION

In view of the foregoing points, an object of the present invention is to provide a paper feeding device that may positively feed the paper from a first paper feeding path portion to a second paper feeding path portion extending in a direction intersecting with the first paper feeding path portion even if the thickness of the paper is increased to increase the rigidity of the paper to some extent, i.e., irrespective of the fact that the paper is thick or thin. Another object of the present invention is to provide a a printer having such a paper feeding device.

In order to attain the above-noted objects, a printer according to the present invention is provided with a paper feeding device in which paper inserted through a first paper feeding path portion is fed to a second paper feeding path portion extending perpendicular to the first paper feeding path portion by a paper feeding roller mechanism, which has a paper feeding guide provided with a first and second main planar portions for defining the outer side walls of the first and second paper fed path portions, in which the paper feeding guide is provided with a plurality of planar connection portions, slanted relative to each other, between the first and second main planar portions so that the paper introduced from the first paper feed portion is guided to the second paper feeding path portion.

In the paper feeding device according to the present invention and the printer having the paper feeding device, the plurality of planar connection portions which are slanted relative to each other are provided between the first and second main planar portions for guiding the paper introduced from the first paper feeding path portion to the second paper feeding path portion. Accordingly, even if the second main planar portion is largely bent relative to the first main planar portion, i.e., even if the angle between the first and second main planar portions is large, it is possible to reduce the angle between the adjacent connection portions along the paper feed direction. Accordingly, in the paper feeding device according to the present invention, in the case where the new paper is loaded, even if the paper is relatively thick (at, for example, about 0.1 mm or more) and the rigidity of the paper is relatively high, it is possible to reduce the angle of the paper to be loaded to be deflected at each planar connection portion. There is a small fear that the leading edge of the paper would collide with the bent portion between the adjacent planar portions of the outer side walls (between the main planar portion and the planar connection portion adjacent to the main planar portion or between the two adjacent planar connection portions).

Incidentally, the paper feeding guide is made of a material which is thin so that is can be disposed at a predetermined position in a narrow space and which has a high mechanical strength. the Preferably, paper feeding guide is made of material such as spring steel. In this case, if the planar connection portions between the first and second main planar portions of the paper feeding guide are formed into the curved shape in a low cost, there is no small fear that the sufficient dimensional precision is not ensured when the steel plate is bent. In contrast, in the case where the planar connection portions are formed of the plurality of planar connection portions and the portions between the adjacent planar portions are bent, it is possible to enhance the dimensional precision relatively in a low cost, and to realize without fail the guide and conversion of the predetermined position and angle of the paper in a low cost.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENTS

Figure 1:
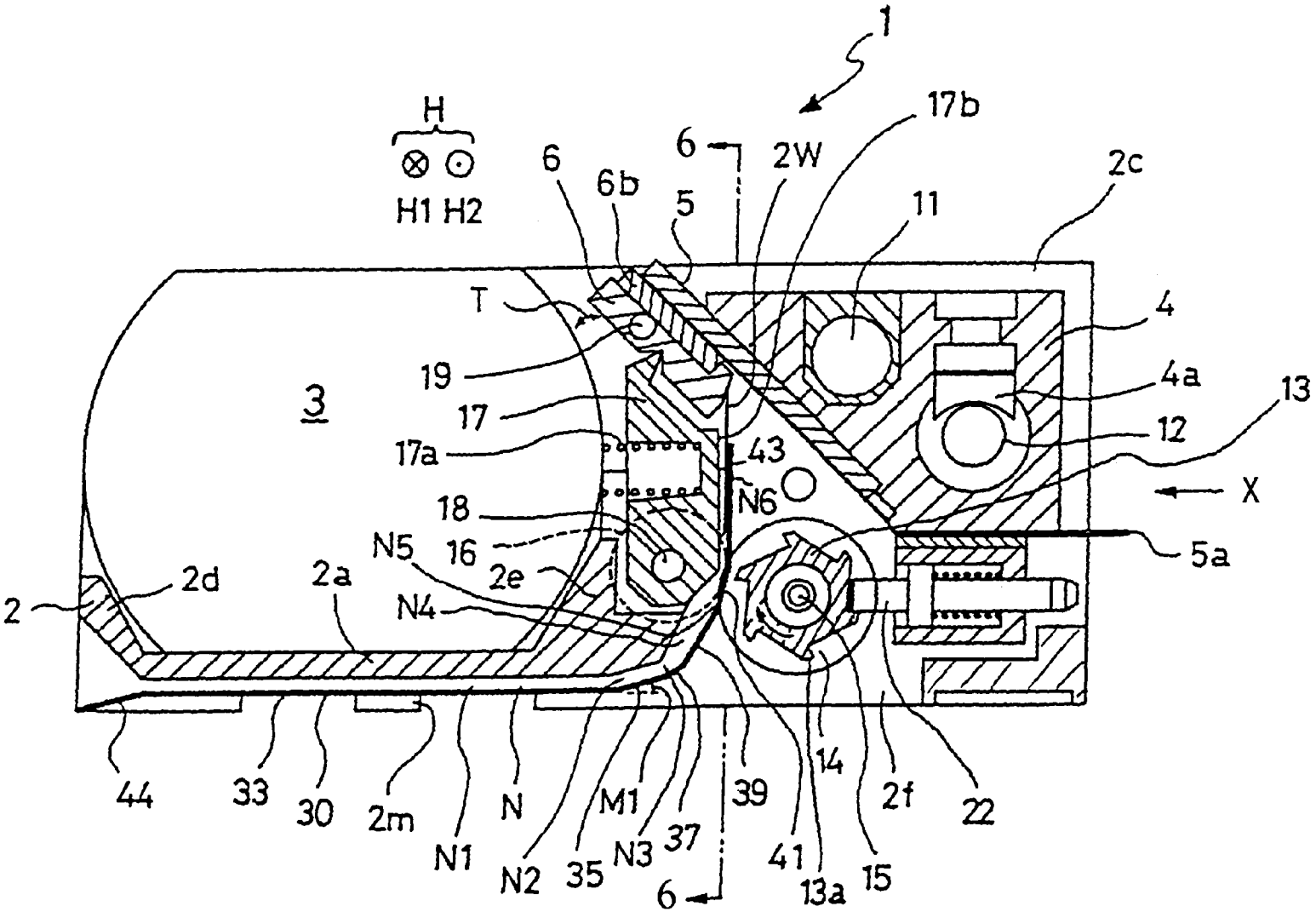
FIG. 1 is a cross-sectional illustration of a printer having a paper feeding device in accordance with a preferred embodiment of the invention, taken along the line 1—1 of FIG. 2.
Figure 2:
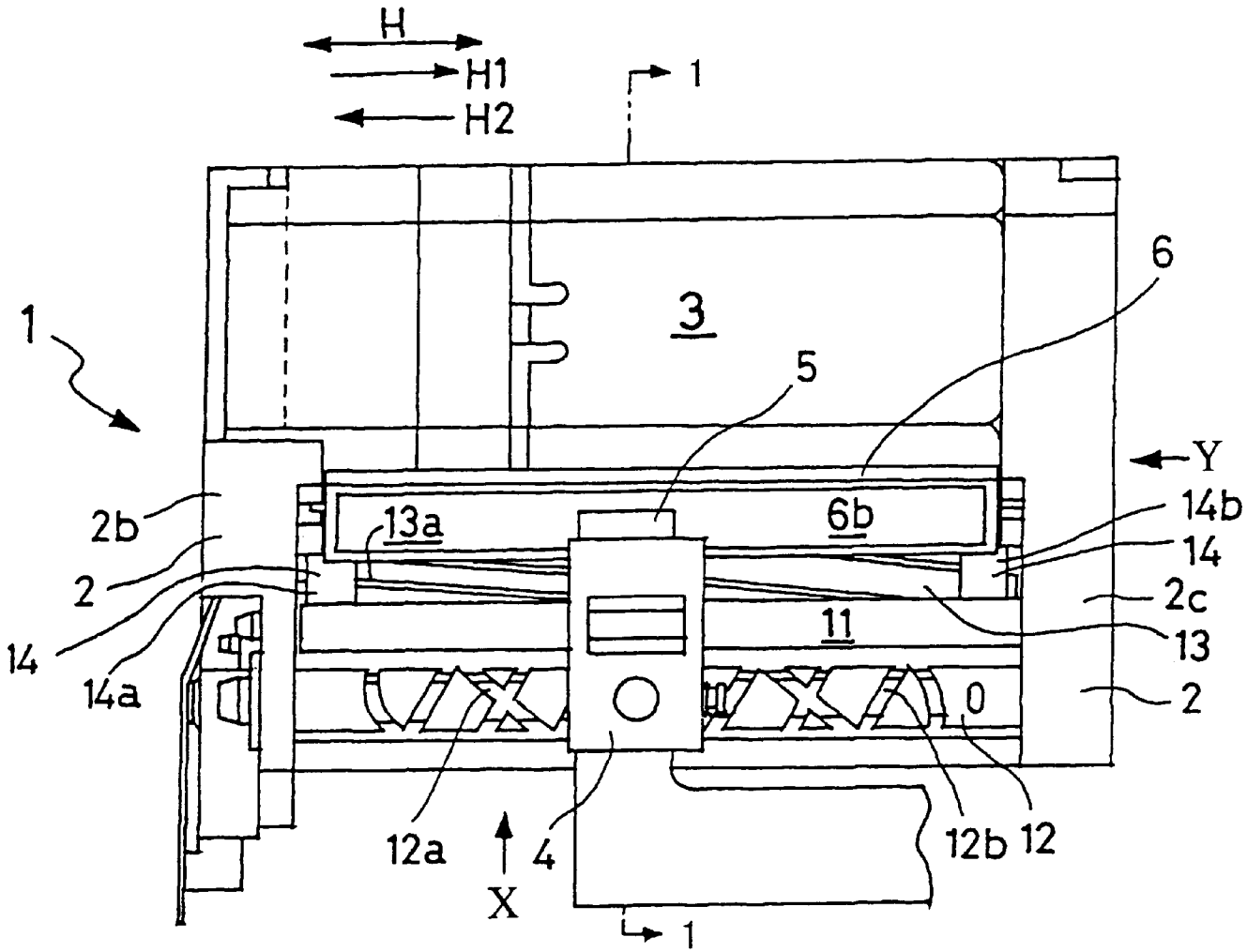
FIG. 2 is a plan illustration of the printer shown in FIG. 1.
Figure 3:
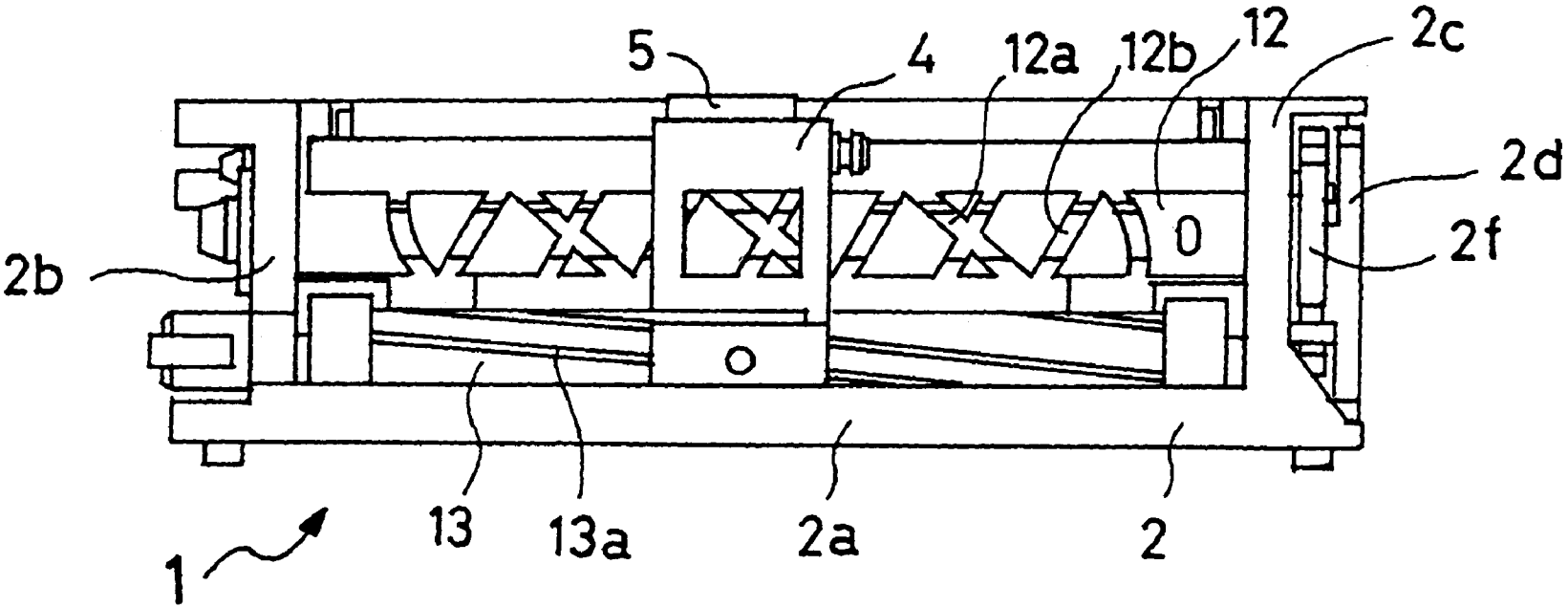
FIG. 3 is a frontal illustration as viewed in the direction of arrow x of the printer shown in FIG. 1.

Typically, the second paper feeding path portion extends in a direction different by an angle of 90° relative to the first paper feeding path portion. At least three planar connections are provided. It is sufficient that the angle between the first and second paper feeding path portions may be smaller or greater than 90°, but it is preferable that the number of the planar connections portions is suitably adjusted so that the angle between the adjacent planar portions is equal to or less than about 30°. This is because, in the case where the rigidity of the paper is relatively high, when the angle between the adjacent planar portions is greater than about 30°, the paper is difficult to be flexible in the vicinity of the paper edge when the paper is inserted and the leading portion is difficult to be deflected. There is not small fear that the paper is collided with the bent portion between the planar portions not to be inserted further. Incidentally, in view of the shape of the portion, where respective connection surface portions faces, out of the inside walls of the paper feeding path, it is preferable that the bent angle (deflection angle) on the upstream side and the downstream side of the respective connection surface portions is determined so that the space occupation in the thickness direction of the paper feeding path is kept at the minimum level while the width of the paper feeding path is kept substantially constant, and the clogging at the tapered portion of the paper feeding path while the paper is buckled at the wide width portion of the paper feeding path is avoided as much as possible.

In the case where the bending rigidity of the paper is relatively high, in view of the fact that the deflection may be easier once the paper begins to be deflected in the vicinity of the leading edge and after that, the relative angle between the adjacent planar portions may be increased on the downstream side or the length in the paper feed direction of the planar connection portions may be reduced on the downstream side. Inversely, in the case where the bending rigidity of the paper is relatively low, when the paper is not actually bent, in view of the fact that the paper loading force applied to the paper at the inlet of the first paper feeding path portion is readily transmitted to the leading edge of the paper, the relative angle between the adjacent planar portions may be increased on the upstream side or the length in the paper feeding direction of the planar connection portions may be reduced on the upstream side. In these cases, there is no problem even if the maximum value of the relative angles between the adjacent planar portions exceeds about 30°.

As described above, the paper feeding guide is made of the thin plate member made of elastic material. It is preferable that the elastic thin plate is supported in the first main planar portion in a cantilever manner. In this case, even if the leading edge of the paper collides with the bent portion between the adjacent planar portions, by the loading force of the paper, (with respect to the paper feeding direction, i.e., the paper loading direction), the planar portion located on the downstream side of the bent portion is somewhat retracted, and the cantilever may be somewhat flexed so that the angle of the bend at the bending portion may be reduced. Accordingly, it is possible to reduce the fear to the minimum level that the leading edge of the paper is subjected to the resistance at the bending portion and is hooked thereat. Incidentally, the portion for supporting the paper feeding guide in the cantilever manner may be located on the upstream end side or on the downstream end side of the first planar portion. In order to fix and support the paper feeding guide itself, however, it is preferable to use an intermediate portion in the paper loading direction of the first surface portion. Also, as described above, it is preferable that the paper feeding guide is made of the elastic thin plate such as a spring plate. For the elastic material, other metal material may be used instead of the spring steel. In some cases, it is possible to use the plastic material. Furthermore, in some cases, instead of supporting the paper feeding guide in the cantilever fashion, the paper feeding guide may be fixed to the frame of the printer at the second main planar portion.

The length in the paper loading direction of each planar connection portion may be kept at the same level. However, in response to the inner side wall shape of the paper feeding path, it is possible to more reduce the length in the paper feeding direction of at least one planar connection portion out of the plurality of planar connection portions than the length of the other planar connection portions. In particular, as mentioned above, in order that the space occupation in the thickness direction of the paper feeding path is kept at the minimum level while the width of the paper feeding path is kept substantially constant, and the clogging at the tapered portion of the paper feeding path while the paper is buckled at the wide width portion of the paper feeding path is avoided as much as possible, it is preferable to shorten the length in the paper feed direction of the planar connection portion facing the largely bent portion of the inner side wall of the paper feeding path.

It is preferable that the planar connection portion most on the downstream side adjacent to the second main planar portion is formed such that the paper coming out and deflected and guided by the connection planar portion may be inserted without fail into the tapered inlet of the paper clamping portion (nip portion) of the paper feeding roller mechanism, and in parallel with the clamp surface (nip surface) of the paper clamping portion and located substantially on the same plane as that of the clamping surface of the paper clamping portion. In this case, the paper fed out from the paper feeding roller mechanism is further bent at the position where it collides with the second main planar portion and is fed to the second main planar portion. Incidentally, preferably, the paper feeding roller mechanism includes at least one paper fed elastic roller (typically, rubber roller) for clamping the papers in cooperation with the facing portion and feeding the paper. More preferably, the paper feeding roller mechanism includes the elastic rollers located at both end positions in the paper feed width direction so as to clamp both ends in the width direction of the paper. Preferably, the portion facing the paper feed elastic roller is made of a roller such as an idler roller. In the case where the paper feeding roller mechanism is composed of such roller pairs, since the leading edge of the paper may be guided by the clamping portion along the circumferential surface of the rollers and there is a degree of freedom to some extent in the orientation of the paper to be introduced into the paper feeding roller mechanism, the planar connection portion adjacent to the second main planar portion may be slanted relative to the clamp surface (nip surface) of the clamping portion to some extent. Incidentally, for the paper feeding roller mechanism, it is possible to use any roller instead of the roller pair. In some cases, the member for forming the paper clamping portion in cooperation with the elastic roller of the paper feeding roller mechanism may be the static support planar or curved surface portion instead of the roller.

For the paper, it is possible to use separate sheets of paper or a continuous type paper. Typically, for example, the width thereof is several centimeters and the thickness thereof is about 0.1 mm or more. The continuous type paper is made of the material having the relatively high rigidity. In the case where the paper feeding roller mechanism is composed of the roller pairs located at both end positions in the paper feed width direction so that the paper feeding roller mechanism clamps both ends of the paper in the width direction, if desired, in order to facilitate the loading of the paper, it is possible to cut, in advance, the leading edge of the paper so as to obtain the shape that the leading edge of the paper is projected at both end portions in the width direction of the paper to be clamped by the respective roller pairs and the recess portion may be formed in the remainder of the leading edge of the paper. Each projecting portion of the leading edge may readily be inserted into the inlet of the paper clamping portion of the paper feeding roller mechanism when the paper is loaded from the first paper feeding path portion. The paper may be thermal paper or any other regular paper for a bubble jet printer or the like. Incidentally, as a matter of course, the thickness of the paper may be thin at about 0.1 mm or less.

A preferred embodiment of the present invention will now be described on the basis of FIGS. 1 to 6.

A printer 1 shown in FIGS. 1 to 6 has a frame 2, a motor 3 mounted on this frame 2, a carrier body (carriage) 4 supported to the frame 2 so as to be reciprocatingly moved in a width direction of the paper of the printer 1, a print head 5 carried on the carrier body 4 for performing the printing operation onto the paper when the carrier body 4 moves forwardly in a direction H1, a platen 6 and a platen rubber 6*b* for supporting a back surface of the paper when the printing operation is performed by the head 5, and a paper feeding roller mechanism for forwarding or feeding the paper by a predetermined pitch corresponding to one line on the downstream side when the carrier body 4 is moved back or returned back to an initial position in a direction H2. The paper feeding roller mechanism is composed of rubber rollers 14, an idler roller 16 and the like as will be described later.

Figure 5:
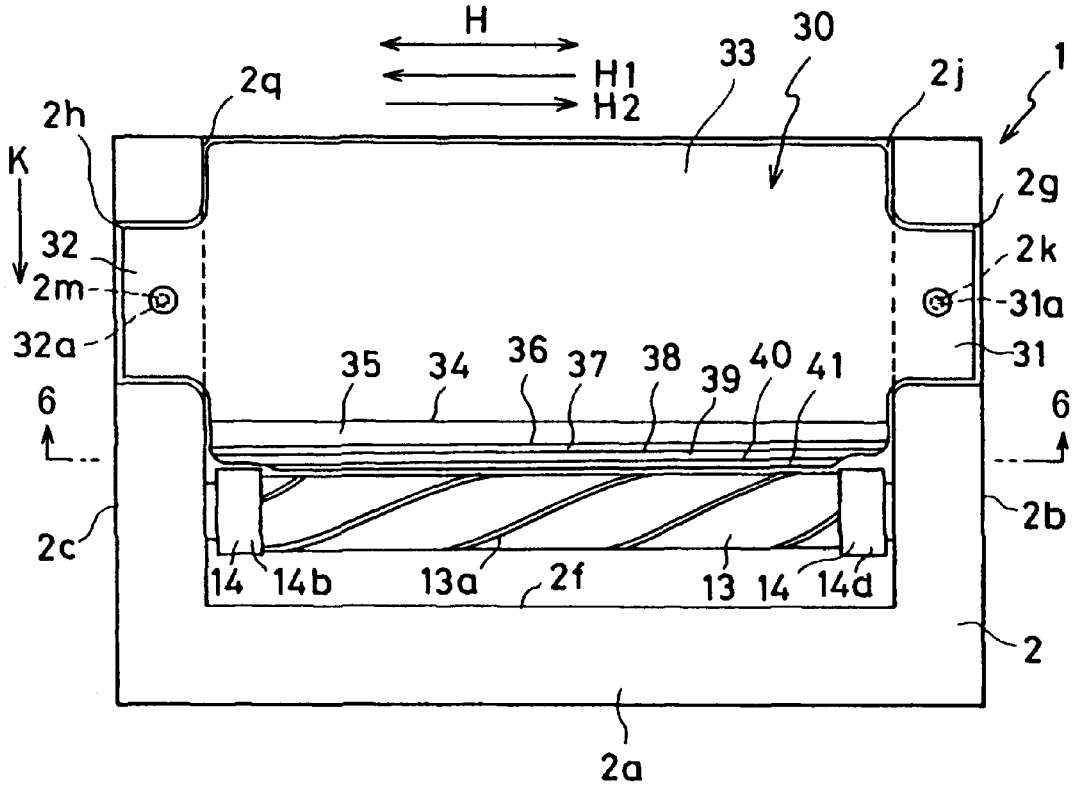
FIG. 5 is a bottom illustration of the printer of FIG. 1 (only showing the main relevant parts)
Figure 6:
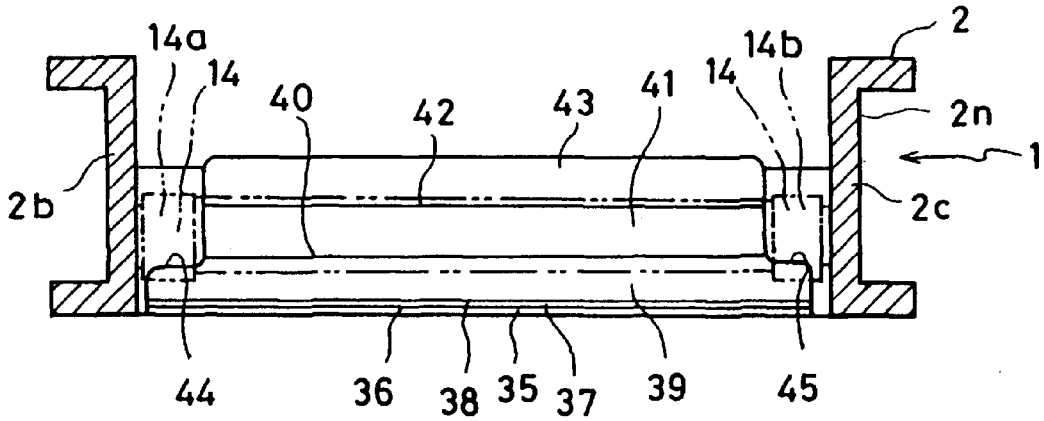
FIG. 6 is a cross-section illustration of the printer shown in FIG. 5, taken along line 6—6 of FIGS. 1 and 5 (only showing the main relevant parts and a rubber roller and a paper feeding roller driver body located on the front side of the cross-section by phantom lines)
Figure 7:
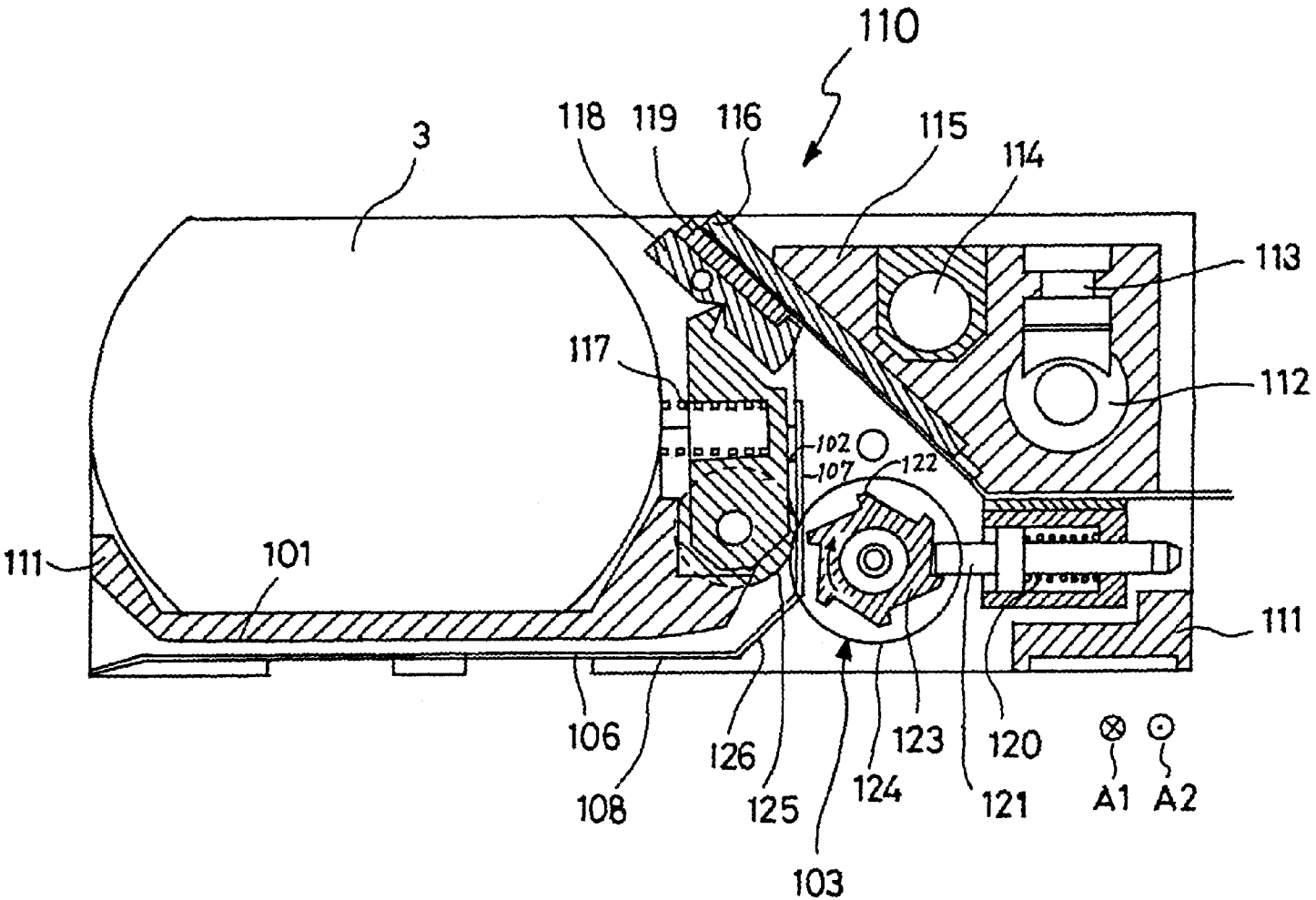
FIG. 7 PRIOR ART
FIG. 7 is a cross-sectional illustration similar to FIG. 1 and showing the conventional printer having the conventional paper feeding device.

The frame 2 integrally made of thermoplastic material has a bottom wall and side walls 2*b* and 2*c* extending upwardly from both end portions in the width direction of the bottom wall 2*a*. The bottom wall 2*a* has a slant end portion 2*d* slanted so as to be located upwardly on the end portion (in FIG. 1) at the upstream end in the paper insertion direction, and a rising portion 2*e* projected upwardly at an intermediate portion in a direction K. In FIG. 1, an opening portion 2*f* spreading over a space between the side walls 2*b* and 2*c* is formed on the right side of the intermediate rising portion 2*e* in FIG. 1. Also, as shown in FIG. 5, shallow recess portions 2*g* and 2*h* are formed on both sides of the bottom surface of the bottom wall 2*a*. A recess portion 2*j* that is deeper than the recess portions 2*g* and 2*h* by a thickness of the paper is formed in the middle of the bottom surface. The recess portion 2*j* extends from the downstream end of the slant end portion 2*d* to the rising end portion 2*e* so that the insertion and feed of the paper may be guided. Incidentally, projections 2*k* and 2*m* for fastening the paper feeding guide to be described later are formed in the middle of both side recess portions 2*g* and 2*h* of the bottom surface.

The motor 3 is arranged in the recess portion formed between the slant end portion 2*d* of the bottom wall 2*a* of the frame 2 and the rising end portion 2*e*. Supported laterally between the side walls 2*b* and 2*c* are a guide shaft 11 and a feeding screw 12 of the carrier body 4, a shaft 15 pivotally supporting the paper feeding roller driver body 13 and the rubber rollers 14, a shaft 18 for pivotally supporting the idler roller 16 and the platen support paper feeding guide member 17, and pins 19 projecting in a direction H from both ends of the platen 6.

Figure 4:
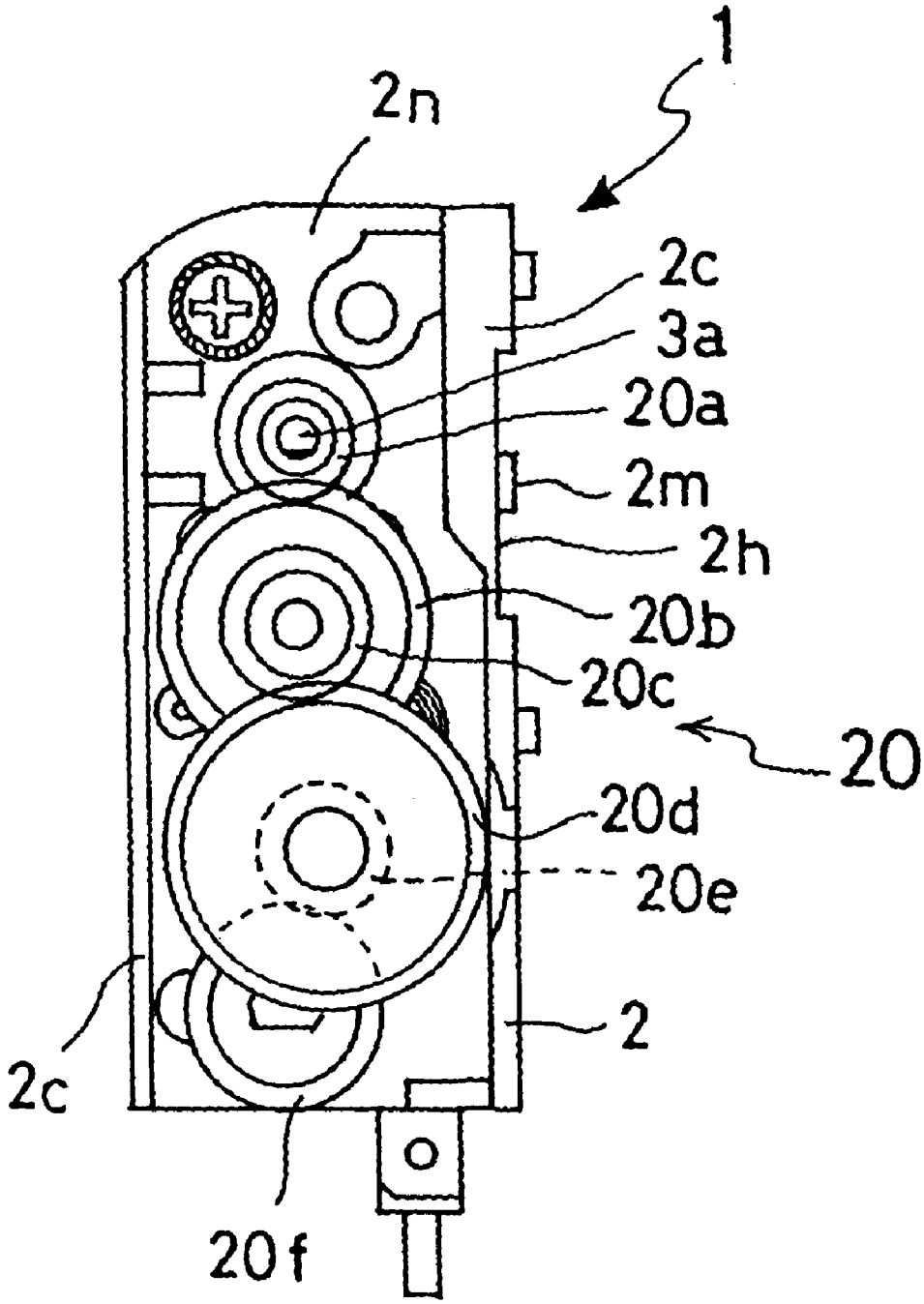
FIG. 4 is a side elevational illustration of the printer of FIG. 2 as viewed in the direction of arrow y.

A gear mechanism 20 composed of gears 20*a*, 20*b*, 20*c*, 20*d*, 20*e* and 20*f* is provided in a recess portion 2*n* formed on an outer surface of the side wall 2*c* of the frame 2 (FIG. 4). The rotation of an output shaft 3*a* of the motor 3 is transmitted through the gear mechanism 20 to the feeding screw 12 of the carrier body 4 formed coaxially with the gear 20*f*. The feeding screw 12 is provided on its circumferential surface with right and left rotational spiral grooves 12*a* and 12*b* which are different in pitch and connected to each other at both ends.

The carrier body 4 is supported slidably in the direction H by the guide shaft 11 and at the same time has a feeding screw pin 4*a* engaged with the spiral grooves 12*a* and 12*b* of the feeding screw 12. The carrier body 4 is reciprocatingly moved in the direction H as the feeding screw 12 rotates. A pin 22 biased on the side of the paper feeding roller driver body 13 by a compression spring is provided on the bottom portion of the carrier body 4. A tip end of the pin 22 is engaged with the paper feeding roller driver body 13 of the paper roller mechanism composed of the rubber rollers 14 and the idler roller 16. The paper feeding roller driver body 13 is provided on its outer circumference with a plurality of spiral claw portions 13*a* that operate in a one-way clutch manner. The driver body 13 allows the pin 22 to move freely in the direction H1 when the carrier body 4 is moved forward in the direction of H1, and to rotate by a predetermined angle by the engagement with the claw portion 13*a* of the pin 22 when the carrier body 4 is moved backward in the direction H2. Incidentally, the rubber rollers 14*a* and 14*b* (generally indicated by reference numeral 14 when it is unnecessary to distinguish them from each other) are coaxially fixed to both ends of the shaft 15 on said shaft 15, i.e., on both sides of the roller driver body 13. The rubber roller 14 clamps and advances the paper in cooperation with the idler roller 16. In this example, the shaft 15 of the rubber roller 14 is located somewhat below the shaft 18 of the idler roller 16 (in FIG. 1). The slant surface of the paper clamping portion of the roller pairs 14 and 16 (the flat surface in parallel with the contact portion, passing through the mutual contact portion of the rollers 14 and 16) is slanted somewhat relative to the vertical direction. However, in some cases, the shaft 18 may be located further below the shaft 15 or may be located substantially in the horizontal position relative thereto. Also, in this example, although the roller pairs 14 and 16 are provided at both ends in the width direction H, it is possible to provide three or more roller pairs or to provide a single pair of rollers. In the former case, for instance, it is possible to provide an additional roller pair in the middle in the width direction H. In this case, as a matter of course, a cutaway extending to the opening (hole) or the downstream end is formed in the intermediate portion of the paper feeding guide in the width direction corresponding to the paper clamping portion defined by the roller pair. Incidentally, in the latter case, for instance, it is possible to provide the roller pair only in the middle portion in the width direction.

The platen 6 is supported swingably in a direction T by the pins 19 engaged with the guide grooves (not shown) formed in the side walls 2*b* and 2*c*, and has a platen rubber 6*b* on its body 6. The platen is swingably biased on the side of the head 5 by a platen support and paper feeding guide member 17 biased by a compression spring 17*a* and rotatable about the shaft 19. In the printing operation, the thermal sensitive coating surface of the paper on the platen rubber 6*b* is depressed lightly against the facing surface of the head 5 on which the heating elements for printing are located. Reference character 5*a* denotes an FPC (flexible printed circuit) for feeding a printing signal (energy) to the heating elements of the head 5.

The paper feeding mechanism for the printer 1 having the above-described schematic structure will now be described in more detail.

Reference numeral 30 denotes a paper feeding guide obtained by punching and bending machining a thin spring steel plate for defining the outer wall of the paper feeding path N. The paper feeding guide 30 has a planar bottom portion 33 supported to the bottom surfaces of the both side recess portions 2*g* and 2*h* of the bottom wall 2*a* of the frame 2 by edge portions 31 and 32 (see FIG. 5) as the first guide portion or main planar portion extending in the horizontal direction in FIG. 1, a first connecting guide portion or planar connection portion 35 formed by bending the downstream end portion of the connecting guide portion or planar bottom portion 33 only by an angle M1, a second connecting guide portion or planar connection portion 37 formed by bending the downstream end portion of the first planar connection portion 35 only by an angle M2 (not shown), a third connecting guide portion or planar connection portion 39 formed by bending the downstream end of the second planar connection portion 37 only by an angle M3 (not shown), a fourth connecting guide portion or planar connection portion 41 formed by bending the downstream end portion of the third planar connection portion 39 only by an angle M4 (not shown) and defining a guide surface substantially in parallel with the clamp surface of the clamping portion in the vicinity of the clamping portion with the idler roller 16 and the rubber roller 14, and a vertically extending planar portion 43 obtained by bending the downstream end portion of the fourth planar connection portion 41 only by an angle M5 (not shown) as the second guide portion or second main planar portion extending substantially upwardly in FIG. 1. In order to avoid the accident that the leading edge of the paper would collide with the bent portions of the respective planar connection portions to be hooked, each of the angles M1 to M5 is selected to be smaller than an angle of 30°. Incidentally, the total sum of the angles M1 to M5 is substantially 90°. Incidentally, in this example, the portion located downstream of the vicinity of the downstream end portion of the third planar connection portion 39 is cut away at cutaways 44 and 45 (FIG. 6) of both ends in the width direction H in order not to interfere with the peripheral portion of the clamping portion between the rubber roller 14 and the idler roller 16. The paper feeding guide 30 is fixed and supported in a cantilever fashion to the frame 2 by thermally press-fitting the projections 2*k* and 2*m*, projecting from the bottom surface of the recess portions 2*g* and 2*h* of the bottom wall 2*a* of the frame 2, through holes 31*a* and 31*b* of the edge portions 31 and 32 of the horizontally extending planar bottom portion 33 of the paper feeding guide 30. Here, the paper feeding device is composed of the paper feeding roller mechanism 7, the paper feeding guide 30, and the portions of the bottom wall 2*a* and the rising portion 2*e* of the frame 2 forming the paper feeding path N in cooperation with the paper feeding guide 30.

In greater detail, the paper feeding path N is composed of the first paper feeding path portion N1 formed between the planar bottom portion 33 of the paper feeding guide 30 and the bottom surface 2*q* of the recess portion 2*j* of the bottom wall 2*a* of the frame 2, the first deflecting path portion N2 formed between the first planar connection portion 35 of the paper feeding guide 30 and the first slant portion formed in the rising portion 2*e* of the frame 2, the second deflecting path portion N3 which is shorter in the paper feeding direction and which is formed to face with the projecting portion between the second planar connection portion 37 of the paper feeding guide 30 and the first and second slant portions of the rising portion 2*e* of the frame 2, the third deflecting path portion N4 formed between the third planar connection portion 39 of the paper feeding guide 30 and the rising end surface of the rising portion 2*e* of the frame 2 and the lower portion of the idler roller 16, the fourth deflecting path portion N5 between the fourth planar connection portion 41 and the circumferential surface of the idler roller 16 in the vicinity of the paper clamping portion between the idler roller 16 and the rubber roller 14, and the second paper feeding path portion N6 formed between the vertical planar portion 43 and the guide surface 2*w* of the frame 2 and the paper feeding guide surface 17*b* of the platen supporting and paper feeding guide member 17. Incidentally, in order to facilitate the insertion of the paper to the first paper feeding path portion N1, a planar slant portion 44 is formed at the upstream end of the paper feeding guide 30 facing the slant surface 2*j* of the frame 2. In this example, the roller pairs 14 and 16 for defining the paper feeding roller mechanism 7 are formed in the fourth deflecting path portion N5. However, the roller pairs may be formed on the upstream side (for example, in the second or third deflecting path portion) or on the downstream side of the paper feeding direction.

The paper feed manipulation and operation of the printer 1 having the thus constructed paper feeding device in accordance with the preferred embodiment of the present invention will now be described.

If the paper is not provided in the printer 1, a roll of continuous paper is set in a predetermined position in the vicinity of the motor 3 of the printer, and a leading edge of the roll paper (for example, having a width of about 4 cm and a thickness of about 0.1 mm) is drawn (after the leading edge has been cut in the width direction if desired). The paper is inserted deeply from the tapered guide path between the slant portions 2*d* and 44 into the paper feeding path N through the first paper feeding path portion N1. Although, typically, a width of the paper is substantially the same as the width of the paper feeding paths N1 to N6, in some cases, it is possible to reduce the width of the paper to the one smaller than the path. In the paper feeding device of this printer 1, since the paper feeding path portion N from the first paper path portion N1 extending in the horizontal direction to the second paper feeding path portion N6 extending in the vertical direction is composed of the plurality of connection path portions N2 to N5 which are bent in a multiple step manner (step by step) in the same direction (counterclockwise in FIG. 1), the leading edge of the inserted paper would neither be collided with nor hooked at each bent portion of each connection path. The edge is inserted into an inlet of the paper clamping portion of the roller pairs 16 and 14 of the paper feed mechanism while being gradually deflecting at the connection path portions N2 to N4 and/or N5. In this state, when the power source for the motor 3 is turned on (or when the power source for the motor 3 is turned on in advance), the motor 3 is drivingly rotated so that its rotation is converted into the reciprocating motion in the direction H of the carrier body 4 through the gear mechanism 20, the feeding screw 12, and the feeding screw pin 4*a*. The backward motion in the direction H2 of the carrier body 4 is converted to the rotation in the paper feed direction of the rubber roller 14, through the pin 22 and the claw provided paper feeding roller driver body 13, and the idler roller 16 that forms the paper clamping portion in cooperation with the rubber roller 14. The paper located at the inlet of the clamping portion is fed while being clamped between the rollers 14 and 16 and reaches the printing position between the head 5 and the platen 6 through the path N6.

Incidentally, in this paper feeding device, since the paper feeding guide 30 is supported in a cantilever manner by the planar bottom portion 33, even if the leading edge of the paper is narrowly hooked by the bending portions of the connection paths, the rising portion of the paper feeding guide is flexible so that the angles of the connection surface portions may be reduced (the bending angle of the path may be reduced) by applying the insertion force to the paper. Accordingly, there is no fear that the leading edge of the paper would be hooked by the bending portions of the connection paths.

Also, in this paper feeding device, since the respective connection surface portions 35, 37, 39 and 41 between the first and second main planar portions 33 and 43 of the paper feeding guide 30 are flat, the bending precision between the planar connection portions 35, 37, 39 and 41 may be enhanced. Accordingly, the paper G may be accurately fed to the paper clamping portion of the paper feeding roller mechanism 7 through the paper feeding path N which is bent in a multistage manner in the same direction.

Incidentally, in this example, in order to keep the width (thickness) of the deflecting paths N2 to N4 substantially constant, the length in the paper feeding direction of the planar connection portions 35, 37, 39 and 41 of the paper feeding guide 30 and the relative angles M1, M2 and M3 thereof are determined so that the deflecting paths are substantially the same contour as that of the surface shape or the like of the frame 2 located inside the deflecting paths. However, instead thereof, the length and the relative angle of the planar connection portions 35, 37, 39 and 41 may be kept substantially constant so as to simply follow a one-fourth circle. In this case, even if the projection or the like between the slant surface portions 2*r* and 2*s* of the rising portion 2*e* is cut away in order to increase a radius of the arc to be followed, a difference in height between the shaft 18 of the idler roller 16 and the shaft 15 of the rubber roller 14 is further increased so that the angle of the clamping portion between the two rollers 16 and 14 may be closer to the horizontal direction in FIG. 1. Also, in view of the fact that the deflection may be easier once the paper begins to be flexed in the vicinity of the leading edge and the leading edge of the paper G is deflected, it is possible to increase the relative angles M between the adjacent planar portions 33, 35, 37, 39, 41 and 43 more on the downstream side or to decrease the length in the paper feed direction of the planar connection portions 35, 37, 39 and 41 more on the downstream side. Inversely, in view of the fact that the insertion force may readily be applied to the leading edge of the paper in the vicinity of the first paper feeding path portion N1, it is possible to increase the relative angles M between the adjacent planar portions 33, 35, 37, 39, 41 and 43 more on the upstream side or to decrease the length in the paper feed direction of the planar connection portions 35, 37, 39 and 41 more on the upstream side.

What is claimed is:

1. A paper feeding device comprising: a first paper feeding path through which paper is introduced; a second paper feeding path extending in a direction intersecting with the first paper feeding path; a paper feeding roller mechanism for feeding the paper from the first paper feeding path to the second paper feeding path, the paper feeding roller mechanism having a paper clamping portion having a clamping surface for clamping the paper; and a paper feeding guide having first and second main planar portions defining outer side walls of the first and second paper feeding paths, respectively, and a plurality of planar connection portions disposed between the first and second main planar portions at an angle relative to one another so that the paper introduced into the first paper feeding path is guided to the second paper feeding path by the paper feeding roller mechanism, one of the planar connection portions being disposed adjacent to the second main planar portion and generally parallel to the clamping surface of the paper clamping portion of the paper feeding roller mechanism.

2. A paper feeding device as claimed in claim 1; wherein the second paper feeding path extends in a direction generally perpendicular to the first paper feeding path; and wherein the plurality of planar connection portions comprises at least three planar connection portions.

3. In a printer having a print head for printing on a recording medium, a paper feeding device according to claim 2 for feeding the recording medium to the print head.

4. A paper feeding device as claimed in claim 1; wherein the paper feeding guide comprises a thin plate made of elastic material and supported in a cantilever manner at the first main planar portion.

5. In a printer having a print head for printing on a recording medium, a paper feeding device according to claim 4 for feeding the recording medium to the print head.

6. A paper feeding device as claimed in claim 1; wherein a length in the paper feeding direction of at least one of the plurality of planar connection portions is smaller than a length of the other planar connection portions.

7. In a printer having a print head for printing on a recording medium, a paper feeding device according to claim 6 for feeding the recording medium to the print head.

8. A paper feeding device as claimed in claim 1; wherein each of the first and second paper feeding paths has a dimension sufficient for receiving paper having a width of several centimeters and a thickness of at least 0.1 mm.

9. In a printer having a print head for printing on a recording medium, a paper feeding device as claimed in claim 8 for feeding the recording medium to the print head.

10. A paper feeding device as claimed in claim 1; wherein the planar connection portions of the paper feeding guide are inclined relative to one another.

11. In a printer having a print head for printing on a recording medium, a paper feeding device according to claim 1 for feeding the recording medium to the print head.

12. A paper feeding device comprising: a paper feeding guide having a first guide portion through which paper having a preselected width and thickness is introduced, a second guide portion for receiving the paper introduced into the first guide portion, and at least one connecting guide portion disposed between the first and second guide portions; and a paper feeding roller mechanism for feeding the paper from the first guide portion to the second guide portion through the connecting guide portion of the paper feeding guide, the paper feeding roller mechanism having a clamping portion for clamping the paper when the paper is fed to the second guide portion, the clamping portion being disposed generally parallel to the connecting guide portion of the paper feeding guide.

13. A paper feeding device according to claim 12; wherein the first and second guide portions of the paper feeding guide are generally perpendicular to one another.

14. A paper feeding device according to claim 12; wherein the at least one connecting guide portion of the paper feeding guide comprises a plurality of connecting guide portions disposed at an angle relative to one another.

15. A paper feeding device according to claim 12; wherein the paper feeding roller mechanism comprises a pair of rollers disposed in confronting relation to one another to form the clamping portion.

16. A paper feeding device according to claim 12; wherein the paper feeding guide is comprised of an elastic material.

17. A paper feeding device according to claim 16; wherein the paper feeding guide is supported in a cantilever manner at the first guide portion.

18. A paper feeding device according to claim 12; wherein the paper feeding guide is supported in a cantilever manner at the first guide portion.

19. A paper feeding device according to claim 12; wherein the first guide portion, the second guide portion and the connecting guide portion of the paper feeding guide are dimensioned so that paper having a width of several centimeters and a thickness of at least 1 mm can be fed therethrough.

20. In a printer having a print head for printing on a recording medium, a paper feeding device according to claim 12 for feeding the recording medium to the print head.

21. In a printer according to claim 20; wherein the at least one connecting guide portion of the paper feeding guide comprises a plurality of connecting guide portions disposed at an angle relative to one another.

* * * * *